US005784962A

United States Patent [19]

Geis et al.

[11] Patent Number: 5,784,962

[45] Date of Patent: Jul. 28, 1998

[54] DEVICE AND METHOD FOR CLEANING CYLINDERS IN A ROTARY PRINTING MACHINE

[75] Inventors: André Geis, St. Leon-Rot.; Thomas Kraft, Leimen, both of Germany

[73] Assignee: Heidelberger Druckmaschinen Aktiengesellschaft, Heidelberg, Germany

[21] Appl. No.: 801,516

[22] Filed: Feb. 18, 1997

[30] Foreign Application Priority Data

Feb. 17, 1996 [DE] Germany ..... 196 05 957.7

[51] Int. Cl.[6] ..... B41F 35/00; G03G 21/00

[52] U.S. Cl. ..... 101/423; 399/345; 399/352; 101/483; 101/425

[58] Field of Search ..... 101/425, 424, 101/423, 483; 399/123, 345, 352

[56] References Cited

U.S. PATENT DOCUMENTS

| | | | |
|---|---|---|---|
| 4,344,361 | 8/1982 | MacPhee et al. | 101/425 |
| 4,537,130 | 8/1985 | Theilacker | 101/425 |
| 4,651,644 | 3/1987 | Kaempfe et al. | 101/425 |
| 4,757,763 | 7/1988 | MacPhee et al. | 101/425 |
| 4,867,064 | 9/1989 | Hara et al. | 101/425 |
| 5,123,354 | 6/1992 | Loos | 101/425 |
| 5,373,789 | 12/1994 | Waizmann | 101/423 |
| 5,519,914 | 5/1996 | Egan | 101/425 |
| 5,537,924 | 7/1996 | Krause | 101/425 |
| 5,644,986 | 7/1997 | Gydessen | 101/425 |

FOREIGN PATENT DOCUMENTS

| | | |
|---|---|---|
| 3005469 | 10/1980 | Germany . |
| 3309557 | 9/1984 | Germany . |
| 4142422 | 6/1993 | Germany . |

*Primary Examiner*—Edgar S. Burr
*Assistant Examiner*—Leslie Grohusky
*Attorney, Agent, or Firm*—Nils H. Ljungman and Associates

[57] ABSTRACT

A device for cleaning the outer cylindrical surfaces of cylinders in a rotary printing machine includes a cleaning cloth extending over the length of a respective cylinder and cooperating with a pressing-on element. The cleaning cloth is pressable against a respective outer cylindrical surface by the pressing-on element. The pressing-on element includes an elastically deformable body having an internal cavity. As internal pressure is applied to the hollow body, the hollow body expands to apply the cleaning cloth to the outer cylindrical surface of the cylinder. Suction is applied to the hollow body to return the cleaning cloth to a disengaged position a substantial distance from the outer cylindrical surface of the cylinder.

20 Claims, 2 Drawing Sheets

DEVICE AND METHOD FOR CLEANING CYLINDERS IN A ROTARY PRINTING MACHINE

BACKGROUND OF THE INVENTION

1. Field of the Invention:

The present invention relates generally to a device for cleaning outer cylindrical surfaces of cylinders in a rotary printing machine. The device can include a cleaning cloth extending over the length of a respective cylinder and cooperating with a pressing-on element. The cleaning cloth can be pressable by means of the pressing-on element against the moving outer cylindrical surface of the respective cylinder. The pressing-on element can include an elastically deformable hollow body to which an internal pressure may be supplied, the hollow body expanding elastically as a result of internal pressure being supplied.

German Patent No. 30 05 469 C2 shows such a cleaning device which, when switching off the internal pressure, produces only a small distance between the cleaning cloth and outer cylindrical surface so that the available gripper fingers may cause damage to the cleaning cloth when, for example, cleaning the outer cylindrical surface of an impression cylinder. As a result thereof, the outer cylindrical surface of the cylinder to be cleaned may not be clean so that the cleaning device does not produce an optimum effect.

OBJECT OF THE INVENTION

Proceeding from this state of the art it is the object of the present invention to enlarge the distance between the outer cylindrical surface to be cleaned and the cleaning cloth, with the cleaning device being disengaged.

SUMMARY OF THE INVENTION

According to the present invention this object can be achieved in that the air supply to the hollow body is preferably carried out by means of a two-way valve. The two-way valve may be switched from overpressure to underpressure, or suction, so that the hollow body may be moved from a position expanded outwards, via a neutral resting position, to a position expanded inwards. If, according to a possible embodiment of the present invention, the cleaning device is assigned to an impression cylinder, an underpressure may be applied to the running printing machine so that the gripper fingers may pass without damaging the cleaning cloth. At standstill of the machine when there is no underpressure, the hollow body can be in a neutral resting position in which the cleaning cloth is not in contact with the outer cylindrical surface.

In other words, the body can include a cavity or hollow having an internal air pressure that can be essentially isolated from the pressure of the air surrounding the pressing-on element. The cavity can be connected to a source of pressurized air to overpressurize the cavity to expand the body and move a cleaning cloth into contact with an outer cylindrical surface of a cylinder of a rotary printing machine. The cavity can be connected to a source of suction air to underpressurize the cavity to deflate or contract or retract the body and move the cleaning cloth a first distance out of contact with an outer cylindrical surface of a cylinder of a rotary printing machine. The selective connection of the body cavity to either the pressurized air or the suction air can be via a two-way, or two-position valve. The retraction of the body caused by the connection to the suction air can be sufficient to provide clearance for gripper fingers of an impression cylinder and prevent interference of the gripper fingers with the cleaning cloth during operation of the rotary printing machine.

When the body is not operatively connected to either the suction air or pressurized air, the internal pressure of the body cavity can be substantially equal to the air pressure surrounding the body or pressing-on element, and the body can assume a neutral, or resting, position wherein the cleaning cloth assumes a second distance away from the outer cylindrical surface of a cylinder of a rotary printing machine. This second clearance distance realized when the body cavity is substantially at the surrounding air pressure can be less than the first clearance distance realized when the body cavity is connected to the suction air.

Another possible embodiment of the present invention is characterized in that the hollow body can feature an outwardly bulged cross-section when in a neutral resting position, with no air being applied. If the hollow body is made preferably of a rubber-like material, this embodiment can make it possible to relatively easily achieve the object of the present invention by means of relatively little overpressure or underpressure.

In other words, for a possible embodiment of the present invention, a portion of the interior surface of the hollow body can have a concave shape to outwardly bulge or bias the cleaning cloth towards the outer cylindrical surface of the cylinder when the cavity of the body is substantially equal to or in equilibrium with the surrounding air pressure, i.e. when the body is in its neutral or resting position.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The present invention is described in greater detail below with reference to the embodiment illustrated in the accompanying drawings, in which.

DESCRIPTION OF THE PREFERRED EMBODIMENT

Figure 1:
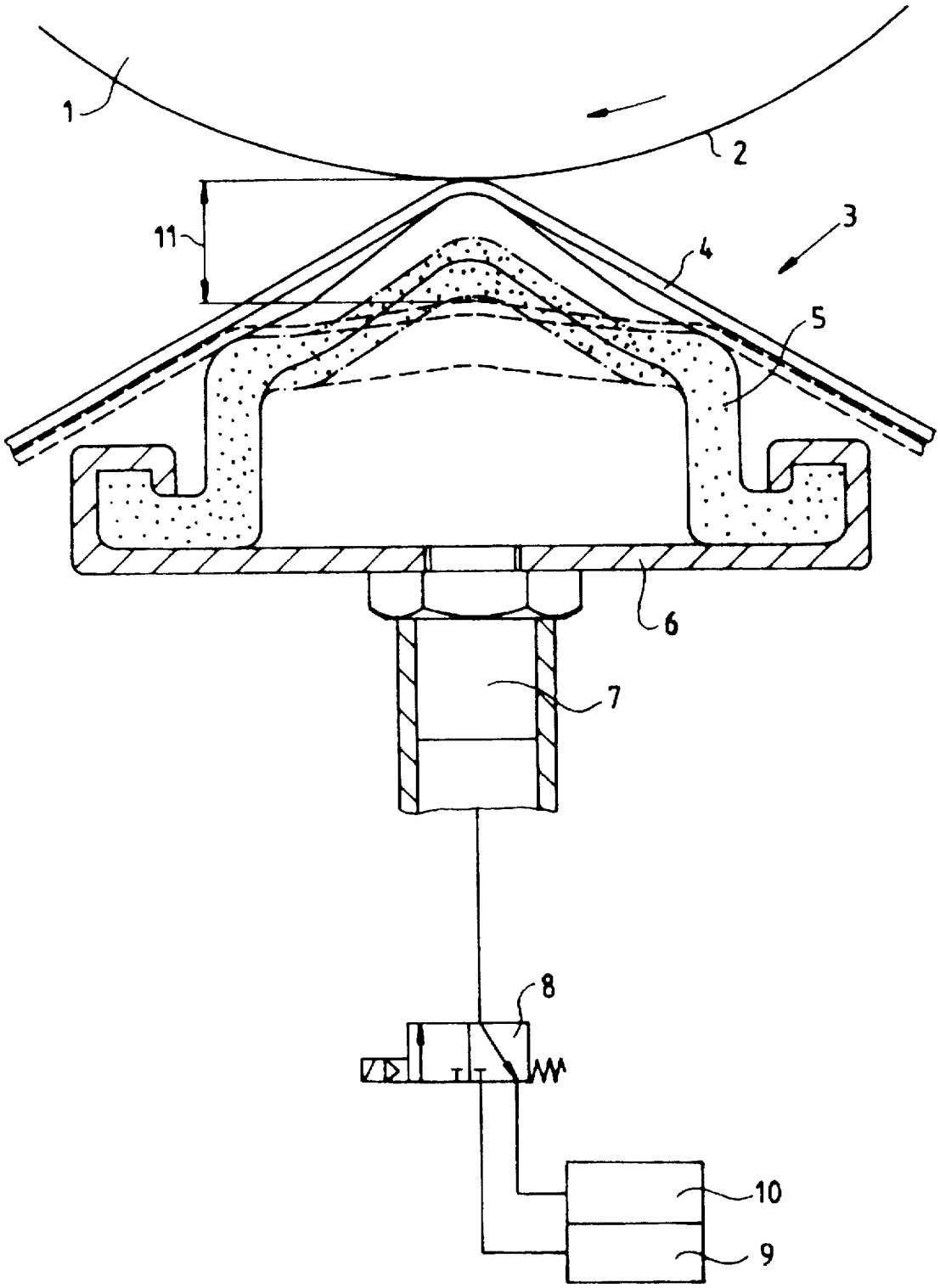
FIG. 1 is a schematic illustration of a specimen embodiment of the present invention.

As shown in FIG. 1, for cleaning an outer cylindrical surface 2 of a cylinder 1 of a rotary printing machine a pressing-on element 3 of a cleaning device can be assigned to the cylinder 1. Via the pressing-on element 3, a cleaning cloth 4 may be pressed against the outer cylindrical surface 2, the cleaning cloth 4 preferably removing dirt and ink residues from the outer cylindrical surface 2 of the rotating cylinder 1.

The pressing-on element 3 can include an elastically deformable hollow body 5. The hollow body 5 can be made, for example, of a rubber-like material, the hollow body 5 being received in a support rail 6. For the air supply, a hose connection 7 preferably connected to a two-way valve 8 can be provided at the support rail 6. The two-way valve 8 can be connected to a pressurized-air producing device 9 and a suction-air producing device 10, so that the air supply to the hollow body 5 may preferably be switched from overpressure to underpressure depending upon the position of the two-way valve 8. The two-way valve 8 is shown in FIG. 1 in a position in which an underpressure can be applied to the hollow body 5.

FIG. 1 shows the hollow body 5 by means of dash-dotted lines; in the neutral resting position of the hollow body 5, the hollow body 5 is shown dotted. When in a position indicated by the solid lines, the hollow body 5 can press the cleaning cloth 4 against the outer cylindrical surface 2. The inwardly expanded position of the hollow body 5 in which there is not applied an underpressure is represented by broken lines. Thus, an essentially enlarged distance 11 between an engaged and a disengaged position of the cleaning cloth 4 with respect to the outer cylindrical surface 2 of cylinder 1 can be provided. In the neutral resting position of the hollow body 5 in which no air is applied, the hollow body 5 can include an outwardly bulged cross-section.

In other words, for a possible embodiment of the present invention, the pressing element 3 can include an air-assisted membrane or hollow body 5 to press the cleaning cloth 4 against the outer cylindrical surface 2 of the cylinder 1. The hollow body 5 can include, for possible embodiments of the present invention, a cavity or a hollow to maintain an internal pressure of the hollow body 5. The hollow body 5 can be deformable in response to changes in internal pressure of the hollow body 5, wherein the deformation of the hollow body 5 generates movement of the cleaning cloth 4 into and out of contact with the outer cylindrical surface 2 of the cylinder 1. The hollow body 5 can preferably be elastically deformable in response to changes of internal pressure, although for other possible embodiments of the present invention some plastic deformation of the hollow body 5 could be acceptable.

The hollow body 5 can preferably have three operating positions, each operating position corresponding to an established internal pressure of hollow body 5.

The first operating position is shown as solid lines in FIG. 1, and can represent the engaged, or cleaning position of the hollow body 5. The hollow body 5 can be connected to the pressurized-air producing device 9 via the two-way valve 8. The pressurized air introduced into the hollow body 5 via the valve 8 can inflate or expand the hollow body 5 to press the cleaning cloth 4 against the outer cylindrical surface 2 of the cylinder 1 for cleaning of the cylinder 1.

The second operating position is shown as dashed lines in FIG. 1, and can represent the disengaged, or retracted position of the hollow body 5. The hollow body 5 can be connected to the suction-air producing device 10 via the two-way valve 8. The suction, or negative pressure, or underpressure, caused by the suction-air producing device 10 being connected to the cavity of hollow body 5 preferably reduces the pressure within the hollow body 5 and can deflate or retract the hollow body 5 so as to move the cleaning cloth 4 away from the outer cylindrical surface 2 and cause the clearance 11 between the cleaning cloth 4 and the outer cylindrical surface 2.

The third operating position of the hollow body 5 is shown as dashed-dotted lines in FIG. 1, and can represent the neutral position or resting position or idle position of the hollow body 5. The hollow body 5 is in effect connected to neither the pressurized-air producing device 9 nor the suction-air producing device 10, so that the internal pressure of the hollow body 5 can essentially equal or be in equilibrium with the outside atmospheric pressure. In its neutral resting position, the hollow body 5 can preferably have a cross-section that bulges towards the outer cylindrical surface 2 of the cylinder 1 to extend the cleaning cloth 4 towards the outer cylindrical surface 2 of the cylinder 1.

The disconnection of the hollow body 5 from both the pressurized-air producing device 9 and the suction-air producing device 10 can be accomplished in different ways for different embodiments of the present invention. Stopping rotation of the cylinder 1 can deenergize or deactuate or turn off both the pressurized-air producing device 9 and the suction-air producing device 10, and can thereby allow the internal pressure of the hollow body 5 to equal or be in equilibrium with the surrounding atmospheric pressure. Or stopping rotation of all cylinders of the printing press, or essentially shutting down or powering off the printing press can also deenergize or deactuate or turn off both the pressurized-air producing device 9 and the suction-air producing device 10. And, in a possible embodiment of the present invention, the valve 8 can include an additional valve position (not shown) wherein the hollow body 5 can be disconnected from both the pressurized-air producing device 9 and the suction-air producing device 10.

For a possible embodiment of the present invention, the hollow body 5 can include a portion 55 (see FIG. 2) for supporting the cleaning cloth 4 when the hollow body 5 is in its (the hollow body 5) neutral resting position. The portion 55 of the hollow body 5 can be configured or shaped to bulge or extend the cleaning cloth 4 towards the outer cylindrical surface 2 of the cylinder 1 when the body 5 is in its neutral resting position.

When the rotary printing machine, or printing press, is inoperative or at a standstill, both the pressurized-air producing device 9 and the suction-air producing device 10 can, for possible embodiments of the present invention, also be inoperative or disconnected from the hollow body 5. The hollow body 5 can thereby attain an equilibrium position wherein the internal pressure of the hollow body 5 can essentially be the same as atmospheric pressure. The equilibrium position of the hollow body 5 can preferably correspond to the third operating position of the hollow body 5.

The hollow body 5 can preferably be made from an elastically deformable material, such as a rubber-like material. In other possible embodiments of the present invention, the hollow body 5 can be made from rubber, plastic, or other materials that are sufficiently deformable in response to pressure changes within the hollow body 5 and can in effect isolate the interior of the hollow body 5 from the surrounding atmospheric pressure. In other possible embodiments of the present invention, the hollow body 5 can be realized as an air-assisted membrane having a cavity.

Figure 2:
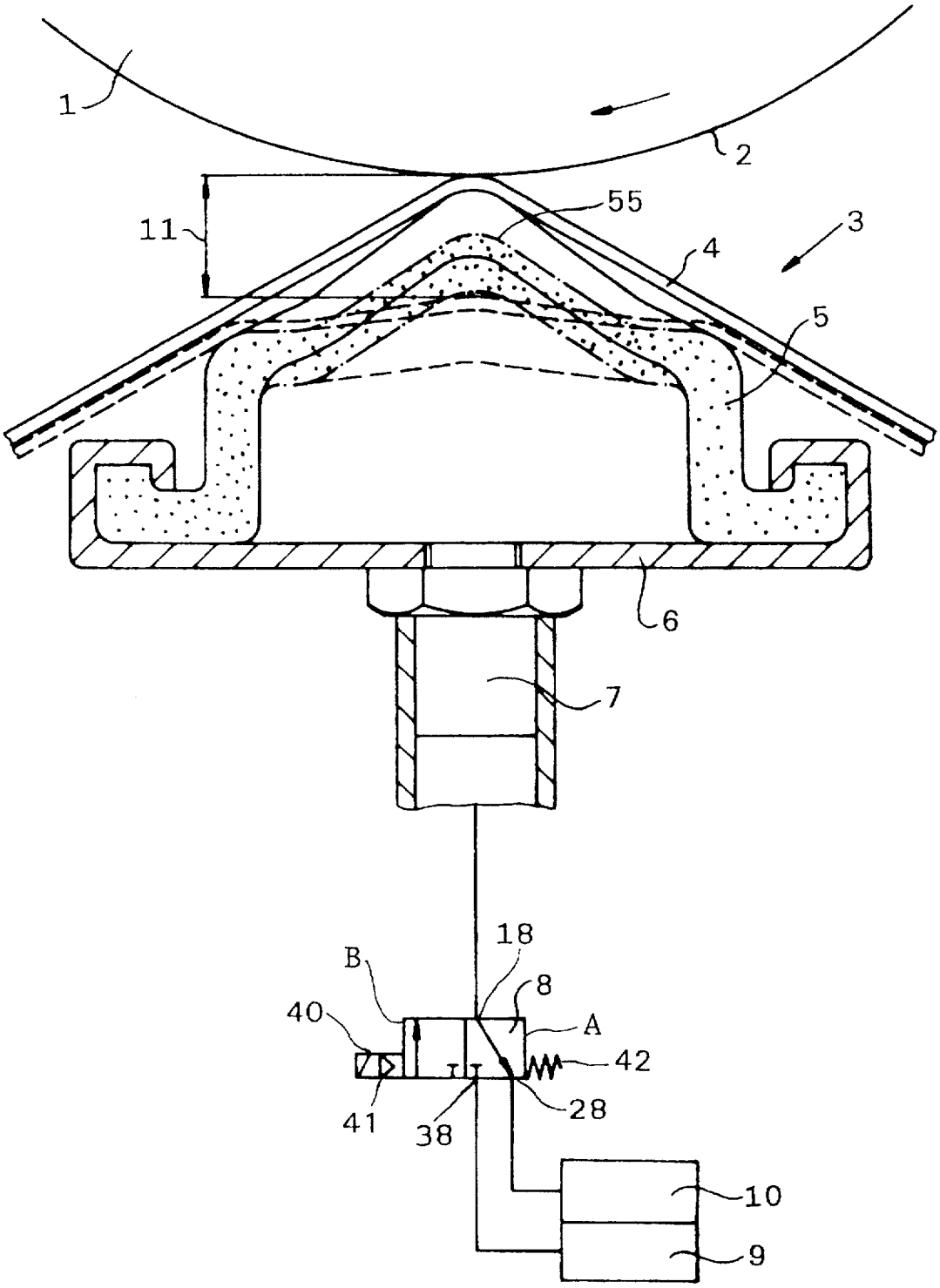
FIG. 2 is similar to FIG. 1 but includes additional reference numerals.

FIG. 2 further illustrates one possible embodiment of the pneumatic circuit shown in FIG. 1. The hollow body 5 can be selectively connected to either the pressurized-air producing device 9 or the suction-air producing device 10 by the two-way valve 8. The two-way valve 8 can be considered a directional valve which valve 8 selectively controls the connection of the hollow body 5 to either the pressurized-air producing device 9 or the suction-air producing device 10, thereby establishing the internal pressure of the hollow body 5. The directional valve or two-way valve 8 can preferably have two positions and three ports. The first port 18 can connect the two-way valve 8 and the hollow body 5, preferably via the hose connection 7. The second port 28 can connect the suction-air producing device 10 to the first port 18, to effectively connect the suction-air producing device 10 to the hollow body 5. The third port 38 can connect the pressurized-air producing device 9 to the first port 18, to effectively connect the pressurized-air producing device 9 to the hollow body 5.

As shown in FIG. 2, in one possible embodiment of the present invention, the two-way valve 8 can have two selectable positions to selectively establish the pressure within the hollow body 5. The two-way valve 8 can have structure to exclusively connect either the second port 28 to the first port 18 or (alternatively) the third port 38 to the first port 18. In the first position of the two-way valve 8, represented in the pneumatic circuit shown in FIG. 2 as "A", the first port 18 can be connected to the second port 28, thereby in effect connecting the hollow body 5 to the suction-air producing device 10. The third port can be closed. In the second position of the two-way valve 8, represented in the pneumatic circuit shown in FIG. 2 as "B", the first port 18 can be connected to the third port 38, thereby effectively connecting the hollow body 5 to the pressurized-air device 9. The second port 28 can be closed. By selecting the appropriate valve position "A" or "B", the cleaning cloth 4 can be engaged with the outer cylindrical surface 2 of the cylinder 1 (valve position "B"), or the cleaning cloth 4 can be retracted away from the outer cylindrical surface of the cylinder 1 (valve position "A").

As shown in FIG. 2, the selection of the two-way valve 8 can be controlled by a solenoid control or solenoid 40 operated by an air pilot 41. The air pilot 41 can actuate the solenoid 40, which solenoid 40 can in turn actuate the valve 8. In one possible embodiment of the present invention, the two-way valve 8 can include a biasing means or spring 42 to bias the two-way valve 8 in a default operating position when the solenoid 40 is not actuated. By actuating the solenoid 40, the two-way valve 8 can be placed in the other, non-default operating position. In other embodiments of the present invention, the two-way valve 8 can be controlled manually to select the operating position of the valve 8. Other methods of controlling the two-way valve 8 are well known, and can be used to suit particular installation needs.

Note that in a possible embodiment of the present invention, the two-way valve 8 can include a third operating position wherein the hollow body 5 can preferably be disconnected from both the pressurized-air producing device 9 and the suction-air producing device 10, to allow the internal pressure of the hollow body 5 to be essentially the same as the atmospheric pressure surrounding the hollow body 5.

In a further possible embodiment of the present invention, the cylinder 1 can be an impression cylinder or plate cylinder of a rotary printing machine. The impression cylinder 1 can carry a printing plate or printing foil (not shown), which printing plate can extend about the outer cylindrical surface 2 of the cylinder 1. A circumferential end of the printing plate can be attached to the cylinder 1 via a registration or clamping device (not shown) that can include gripper fingers to grasp an end of the printing plate. These gripper fingers, or equivalent clamping structures, along with possibly other portions of the registration device, can extend radially outward from the outer cylindrical surface 2 of the impression cylinder 1, and therefore can possibly interfere with or contact the cleaning cloth 4. Therefore, the hollow body 5 can preferably be connected to the suction-air producing device 10 to retract the cleaning cloth 4 and create the clearance or gap 11 between the cleaning cloth 4 and the impression cylinder 1, so that interference between the registration device and the cleaning cloth 4 can be eliminated.

One feature of the present invention resides broadly in the device for cleaning outer cylindrical surfaces of cylinders in a rotary printing machine, said device comprising a cleaning cloth extending over the length of a respective cylinder and cooperating with a pressing-on element, with said cleaning cloth being pressable against the moving outer cylindrical surface by means of said pressing-on element, and said pressing-on element consisting of an elastically deformable hollow body to which an internal pressure may be applied and which elastically expands when applying an internal pressure, characterized in that the air supply to a hollow body 5 is carried out by means of a two-way valve 8, and in that said two-way valve 8 may be switched from overpressure to underpressure so that said hollow body 5 may be moved from an outwardly expanded position, via a neutral resting position, to an inwardly expanded position.

Another feature of the invention resides broadly in the device characterized in that, when being in its neutral position, said hollow body 5 features an outwardly bulged cross-section, with no air being applied.

An example device for cleaning cylinder surfaces in printing presses in which the present invention can possibly be incorporated, and which example device illustrates other components that can possibly be used in conjunction with the present invention is disclosed by U.S. patent application No. 08/784,402, filed Jan. 17, 1997 having inventor Jens Friedrichs and assigned to the same assignee of the present invention and titled "Device for Cleaning Cylinder Surfaces in Printing Presses" with Attorney Docket No. NHL-HBD-141 and claiming priority from Federal Republic of Germany Patent Application No. 196 01 471.9 filed on Jan. 17, 1996, said U.S. patent application being hereby incorporated by reference as if fully set forth herein.

Other examples of cleaning devices for printing presses which may be utilized in accordance with the present invention can be found in the following U.S. Pat: No. 4,651,644, No. 4,922,821, No. 4,981,078, No. 4,991,507, No. 5,105,740, No. 5,150,650 and No. 5,537,924. An example of a cleaning device for printing presses which uses an air-assisted membrane in the application element can be found in U.S. Pat. No. 4,344,361.

Examples of directional valves that could be used or could be adapted for use in accordance with the present invention, as well as components generally used with directional valves could be disclosed by the following U.S. Pat: No. 5,520,217, No. 5,227,868, No. 4,995,424, No. 4,567,914 and No. 4,526,201.

Examples of pneumatic circuits and other examples of directional valves and valve actuation devices and other pneumatic and hydraulic devices adaptable for use in the context of the present invention, as well as commonly accepted pneumatic circuitry symbols and sources for commonly accepted pneumatic circuitry symbols, can be found in the fourth edition of the publication titled "Pneumatics and Hydraulics", copyright 1984and authored by Harry L. Stewart and revised by Tom Philbin, published by the Bobbs-Merrill Co and having ISBN 0-672-23412-2.

Examples of registration or clamping devices for clamping printing plates to plate cylinders or impression cylinders of printing presses that could be used in accordance with the present invention, as well as components generally used with such registration or clamping devices could be found in the following U.S. Pat.: No. 5,596,928, No. 5,503,072, No. 5,495,804, No. 5,461,980, No. 4,831,931 and No. 4,831,931.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 196 05 957.7, filed on Feb. 27, 1996, having inventors Andre Geis and Thomas Kraft, and DE-OS 196 05 957.7 and DE-PS 196 05 957.7, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicants' option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A device for cleaning an outer cylindrical surface of a cylinder in a rotary printing machine, said device comprising:

an apparatus to permit a cloth to be disposed thereon to clean an outer cylindrical surface of a cylinder of a rotary printing machine;

said apparatus comprising an element to selectively move a cleaning cloth into contact with an outer cylindrical surface of a cylinder of a rotary printing machine and out of contact with an outer cylindrical surface of a cylinder of a rotary printing machine;

said element having a cavity;

said element being deformable in response to changes of pressure within said cavity of said element;

a valve structure comprising a first port;

said first port of said valve structure being connected to said cavity of said element;

said valve structure comprising a second port;

said second port of said valve structure comprising an arrangement to connect to a source of pressurized air;

said valve structure comprising a third port;

said third port of said valve structure comprising an arrangement to connect to a source of suction air; and said valve structure comprising structure to selectively connect either said second port to said first port or said third port to said first port.

2. The device according to claim 1, wherein:

said element comprises an expandable and contractable element expandable and contractable upon pressure changes within said cavity to move a cleaning cloth a first distance from an outer cylindrical surface of a cylinder of a rotary printing machine upon the pressure within said cavity of said element being substantially equal to the air pressure about said element and to move a cleaning cloth a second distance from an outer cylindrical surface of a cylinder of a rotary printing machine upon the pressure within said cavity of said element being substantially equal to the pressure of a source of suction air, with the second distance being greater than the first distance.

3. The device according to claim 2, wherein:

said element comprises a portion to support a cleaning cloth thereon upon the pressure within said cavity of said element being substantially equal to the air pressure about said element; and said portion of said element comprises an outwardly bulged portion extending away from the remainder of said element upon the pressure within said cavity being substantially equal to the air pressure about said element to extend said portion of said element towards an outer cylindrical surface of a cylinder to extend a cleaning cloth towards an outer cylindrical surface of a cylinder of a rotary printing machine and away from the remainder of said element.

4. The device according to claim 3, wherein:

said element comprises a deformable material; and said material being elastically deformable in response to changes of pressure within said cavity of said element.

5. The device according to claim 4, wherein:

said valve structure comprises a solenoid;

said solenoid is operatively connected to said selectively connecting structure of said valve structure;

said selectively connecting structure of said valve structure comprises an arrangement to connect said first port of said valve structure to one of said second and third ports of said valve structure during actuation of said solenoid; and said selectively connecting structure of said valve structure is configured to connect said first port to the other of said second and third ports of said valve structure during deactuation of said solenoid.

6. The device according to claim 5, wherein:

said valve structure comprises an air pilot;

said air pilot is operatively connected to said solenoid;

said air pilot is disposed to actuate said solenoid upon actuation of said air pilot;

said selectively connecting structure of said valve structure comprises an arrangement to connect said first port of said valve structure to said second port of said valve structure during actuation of said solenoid; and said selectively connecting structure of said valve structure comprises an arrangement to connect said first port of said valve structure to said third port of said valve structure during deactuation of said solenoid.

7. The device according to claim 6, wherein:

said apparatus comprises an arrangement to dispose said apparatus adjacent to an outer cylindrical surface of an impression cylinder of a rotary printing machine.

8. A device for cleaning outer cylindrical surfaces of cylinders in a rotary printing machine, said device comprising:

an apparatus to press-on a cleaning cloth to an outer cylindrical surface of a respective cylinder;

said apparatus to press-on including an expandable hollow body;

said expandable hollow body comprising a cavity to expand said expandable hollow body upon a pressurized source being connected to said cavity;

an arrangement to selectively connect said cavity to either a pressurized source or a suction source to selectively move said expandable hollow body from an outwardly expanded position adjacent an outer cylindrical surface for bringing a cleaning cloth into contact with an outer cylindrical surface upon connection to a pressurized source, via a neutral resting position, to an inwardly expanded position spaced away from an outer cylindrical surface for withdrawing a cleaning cloth from an outer cylindrical surface upon connection to a suction source.

9. The device according to claim 8 wherein said expandable hollow body comprises an elastically deformable hollow body.

10. The device according to claim 9 wherein said elastically deformable hollow body comprises an outwardly bulged cross-section upon said elastically deformable hollow body being in the neutral position upon a pressure in said cavity being substantially equal to a pressure surrounding said apparatus.

11. The device according to claim 10, wherein:

said selectively connecting arrangement comprises a two-way valve;

said two-way valve comprises a solenoid; and said solenoid is disposed to selectively switch said two-way valve from one of: a pressurized source and a suction source to the other one of: a pressurized source and a suction source.

12. The device according to claim 11, wherein:

said two-way valve comprises a biasing element; and said biasing element is disposed to switch said two-way valve from the other one of: a pressurized source and a suction source to the one of: a pressurized source and a suction source upon deactivation of said solenoid.

13. The device according to claim 12, wherein:

said solenoid is disposed to switch said two-way valve from a suction source to a pressurized source upon activation of said solenoid;

said biasing element is disposed to switch said two-way valve from a pressurized source to a suction source upon deactivation of said solenoid;

said two-way valve comprises an air pilot; and said air pilot is disposed to activate said solenoid upon activation of said air pilot.

14. A method of cleaning an outer cylindrical surface of a cylinder in a rotary printing machine with a device for cleaning an outer cylindrical surface of a cylinder in a rotary printing machine, said device comprising an apparatus to permit a cloth to be disposed thereon to clean an outer cylindrical surface of a cylinder of a rotary printing machine; the apparatus comprising an element to selectively move a cleaning cloth into contact with an outer cylindrical surface of a cylinder of a rotary printing machine and out of contact with an outer cylindrical surface of a cylinder of a rotary printing machine; the element having a cavity; the element being deformable in response to changes of pressure within the cavity of the element; a valve structure comprising a first port; the first port of the valve structure being connected to the cavity of the element; the valve structure comprising a second port; the second port of the valve structure being connected to a source of pressurized air; the valve structure comprising a third port; the third port of the valve structure being connected to a source of suction air; and the valve structure comprising structure to selectively connect either the second port to the first port or the third port to the first port, said method of cleaning comprising the steps of:

disposing a cleaning cloth on the element;

connecting the cavity of the element to the source of pressurized air;

inflating the element with the source of pressurized air;

moving said cleaning cloth into contact with an outer cylindrical surface of a cylinder of a rotary printing machine;

rotating a cylinder of a rotary printing machine in contact with said cleaning cloth;

cleaning an outer cylindrical surface of a cylinder of a rotary printing machine with said cleaning cloth during rotation;

connecting the cavity of the element to the source of suction air;

deflating the element with the source of suction air; and moving said cleaning cloth out of contact with an outer cylindrical surface of a cylinder upon the completion of cleaning of an outer cylindrical surface of a cylinder.

15. The method according to claim 14, wherein the element further comprises an elastically deformable material, said method comprising:

elastically deforming the material in response to changes in pressure within the cavity of the element.

16. The method according to claim 15, further comprising:

moving said cleaning cloth a first distance from an outer cylindrical surface of a cylinder of a rotary printing machine upon the pressure within the cavity of the element being substantially the air pressure about the element;

moving said cleaning cloth a second distance from an outer cylindrical surface of a cylinder of a rotary printing machine upon the cavity of the element being connected to the source of suction air, the second distance being greater than the first distance;

said step of moving said cleaning cloth out of contact with an outer cylindrical surface of a cylinder upon the completion of cleaning of an outer cylindrical surface of a cylinder comprises the step of moving said cleaning cloth the second distance from an outer cylindrical surface of a cylinder upon the completion of cleaning of an outer cylindrical surface of a cylinder;

stopping rotation of a cylinder of a rotary printing machine that had been cleaned with said cleaning cloth during rotation of a cylinder; and moving said cleaning cloth the first distance from an outer cylindrical surface of a cylinder upon the stopping of rotation of a cylinder.

17. The method according to claim 16, wherein said step of stopping rotation of a cylinder of a rotary printing press that had been cleaned with said cleaning cloth during rotation of a cylinder further comprises the step of stopping rotation of all of the cylinders of a rotary printing press.

18. The method according to claim 17, wherein the element comprises an outwardly bulged portion upon a pressure in the cavity of the element being substantially equal to a pressure about the element, said method comprising:

supporting a cleaning cloth with the outwardly bulged portion upon the pressure within the cavity of the element being substantially equal to the air pressure about the element and upon moving said cleaning cloth the first distance from an outer cylindrical surface of a cylinder.

19. The method according to claim 18, wherein the valve structure comprises a solenoid operatively connected to the selectively connecting structure of the valve structure, and wherein:

said step of inflating the element comprises actuating the solenoid and connecting the first port of the valve structure to the second port of the valve structure; and said step of deflating the element comprises deactuating the solenoid and connecting the first port of the valve structure to the third port of the valve structure.

20. The method according to claim 19, wherein the valve structure comprises an air pilot operatively connected to the solenoid, said method comprising:

actuating the solenoid with the air pilot upon actuation of the air pilot.

* * * * *